US007153146B2

(12) United States Patent
Shimizu et al.

(10) Patent No.: US 7,153,146 B2
(45) Date of Patent: Dec. 26, 2006

(54) TERMINATION STRUCTURE OF CABLE WITH SHIELD LAYER

(75) Inventors: Michiaki Shimizu, Tokyo (JP); Noboru Sato, Tokyo (JP); Shinji Ito, Tokyo (JP); Nobuyuki Yamashita, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 89 days.

(21) Appl. No.: 11/106,684

(22) Filed: Apr. 15, 2005

(65) Prior Publication Data

US 2006/0234547 A1 Oct. 19, 2006

(51) Int. Cl.
*H01R 13/648* (2006.01)

(52) U.S. Cl. ..... 439/98; 174/78; 439/932; 439/730

(58) Field of Classification Search ..... 439/98, 439/610, 523, 932, 730; 174/78, 75 C
See application file for complete search history.

(56) References Cited

U.S. PATENT DOCUMENTS 5,691,506 A * 11/1997 Miyazaki et al. ..... 174/652
6,042,396 A * 3/2000 Endo et al. ..... 439/98
6,893,273 B1 * 5/2005 Sato et al. ..... 439/98

FOREIGN PATENT DOCUMENTS

| | | | | |
|---|---|---|---|---|
| GB | 2244388 A | * | 11/1991 | ..... 174/78 |
| JP | 2001-313100 A | | 11/2001 | |
| JP | 2002-260773 A | | 9/2002 | |
| JP | 2002-270281 A | | 9/2002 | |
| JP | 2005-027446 A | | 1/2005 | |

* cited by examiner

*Primary Examiner*—Tho D. Ta
(74) *Attorney, Agent, or Firm*—Foley & Lardner LLP

(57) ABSTRACT

A termination structure of a cable with a shield layer wherein a part of a jacket of the cable is removed at an end of the cable to expose a part of the shield layer and the exposed part of the shield layer is grounded to a fitting object and the cable is fitted in water-tightness with the fitting object. The termination structure has: a metallic sleeve disposed on the jacket of the cable, the metallic sleeve being covered with the exposed part of the shield layer being folded at an end of the jacket; a cylindrical metal fitting being disposed on the periphery of the folded shield layer and swaged at a fixing section corresponding to the folded shield layer to fix the cable; and a heat-shrinkable tube disposed on the periphery of the cylindrical metal fitting and the jacket.

9 Claims, 5 Drawing Sheets

TERMINATION STRUCTURE OF CABLE WITH SHIELD LAYER

The present application is based on Japanese patent application No. 2003-191130, the entire contents of which are incorporated herein by reference.

BACKGROUND OF THE INVENTION

1. Field of the Invention

The present invention relates to a method for fabricating a termination structure of a cable with a shield layer to be connected to electrical instruments which are constituted in water-tightness such as a battery, an inverter, and a motor in an electric vehicle.

2. Description of the Related Art

As a termination structure of a cable with a shield layer which is wired between a battery and an inverter, or an inverter and a motor in an electric vehicle, the one described in Japanese patent application laid-open No. 2001313100 is known.

As shown in FIG. 1, a cable 50 with a shield layer is prepared by overlaying successively a core wire 51, an insulation layer 52, a shield layer 53, and an jacket 54 one another in this order. A termination structure 55 of the cable 50 is constituted in such that the jacket 54 of the cable 50 with the shield layer is removed to expose the shield layer 53, an end of a sleeve 56 having a small diameter and made of a metal is inserted into the interior of the shield layer 53, the outer circumference of the shield layer 53 and the outer circumference of the jacket 54 are covered with another sleeve 57 having a large diameter and made of a metal, the sleeve 57 of a large diameter is swaged inwardly in the diametrical direction, and the other end of the sleeve 56 of a small diameter 56 is pressed into a conductive flange 59 fixed to a shield wall 58 of an inverter and the like. Thus, it is arranged in such that when the shield layer 53 is connected to the conductive flange 59 through the sleeve 56 of a small diameter, the cable 50 with the shield layer is fitted to the shield wall 58 in a grounded condition.

Furthermore, a housing 61 is monolithically resin-molded so as to cover collectively a waterproof cylinder section which has been preliminarily molded on the jacket 54, the sleeve 57 of a large diameter, the sleeve 56 of a small diameter, and a cable peripheral section of the conductor flange 59, whereby a shield section between the shield layer 53 and the conductive flange 59 is waterproofed.

There are, however, such problems that the above-mentioned termination structure 55 is composed of a large number of parts, and a yield thereof cannot be increased because the housing 61 is manufactured by means of matched-mold forming, resulting in high production costs. Besides, when the sleeve 57 of a large diameter is swaged, the sleeve 56 of a small diameter is also deformed. As a result, there is a fear of damaging the insulation layer 52 being electrically important.

For example, the other related arts are disclosed in Japanese patent application laid-open Nos. 2002-260773 and 2002-270281.

SUMMARY OF THE INVENTION

It is an object of the present invention to provide a termination structure of a cable with a shield layer that the cable can be securely and in water-tightness fitted with a fitting object at a reduced cost.

(1) According to one aspect of the invention, a termination structure of a cable with a shield layer wherein a part of a jacket of the cable is removed at an end of the cable to expose a part of the shield layer and the exposed part of the shield layer is grounded to a fitting object and the cable is fitted in water-tightness with the fitting object, comprises:

a metallic sleeve disposed on the jacket of the cable, the metallic sleeve being covered with the exposed part of the shield layer being folded at an end of the jacket;

a cylindrical metal fitting comprising a flange section through which the cylindrical metal fitting is secured to the fitting object, the cylindrical metal fitting being disposed on the periphery of the folded shield layer and swaged at a fixing section corresponding to the folded shield layer to fix the cable; and a heat-shrinkable tube disposed on the periphery of the cylindrical metal fitting and the jacket.

It is preferred that the termination structure further comprises a resin layer formed in a gap between the jacket of the cable and the cylindrical metal fitting to seal the gap.

It is preferred that the cylindrical metal fitting comprises an insertion section being inserted into the fitting object and a projection section protruding outside the fitting object, the projection section is disposed on the periphery of the folded shield layer, and an insulation layer of the cable exposed without the shield layer is inserted through the insertion section into the cylindrical metal fitting.

It is preferred that the termination structure further comprises an annular seal disposed on the periphery of the insertion section to seal a gap between the insertion section and the fitting object.

It is preferred that the projection section comprises a groove formed on its periphery to engage an end of the heat-shrinkable tube with the groove to fix the tube.

It is preferred that the projection section comprises a plurality of the grooves formed on the periphery in an axial direction of the cylindrical metal fitting.

It is preferred that the projection section comprises a diameter expansion section formed adjacent to the groove on the periphery to increase a depth of the groove.

(2) According to another aspect of the invention, a termination structure of a cable with a shield layer wherein a part of a jacket of the cable is removed at an end of the cable to expose a part of the shield layer and the exposed part of the shield layer is grounded to a fitting object and the cable is fitted in water-tightness with the fitting object, comprises:

a metallic sleeve disposed on the jacket of the cable, the metallic sleeve being covered with the exposed part of the shield layer being folded at an end of the jacket;

a cylindrical metal fitting comprising a flange section through which the cylindrical metal fitting is secured to the fitting object, and an end section formed in a horn shape that allows an end of the cylindrical metal fitting to open radially from an axis of the cable, the cylindrical metal fitting being disposed on the periphery of the folded shield layer and swaged at a fixing section corresponding to the folded shield layer to fix the cable; and an embedding seal provided in the end section to seal a gap between the cable and the cylindrical metal fitting.

ADVANTAGES OF THE INVENTION (1) The cable with the shield layer can be easily and securely in water-tightness fitted to the fitting object.

(2) The termination structure of the cable with the shield layer can be made at a reduced cost.

BRIEF DESCRIPTION OF THE DRAWINGS

The present invention will be explained in more detail in conjunction with appended drawings, wherein.

DESCRIPTION OF THE PREFERRED EMBODIMENTS

First Embodiment

Figure 1:
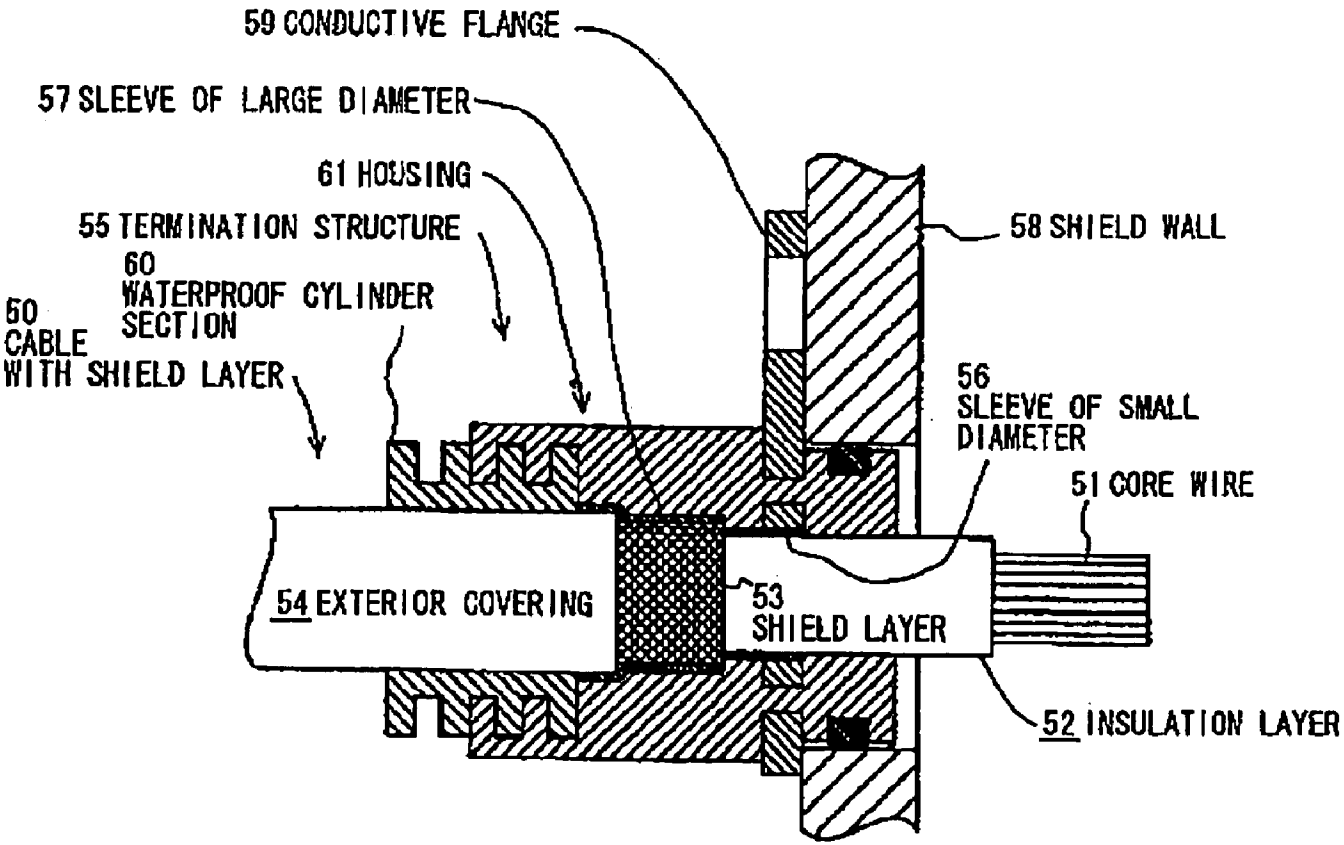
FIG. 1 PRIOR ART
FIG. 1 is a cross sectional view showing the conventional termination structure of the cable with the shield layer.
Figure 2:
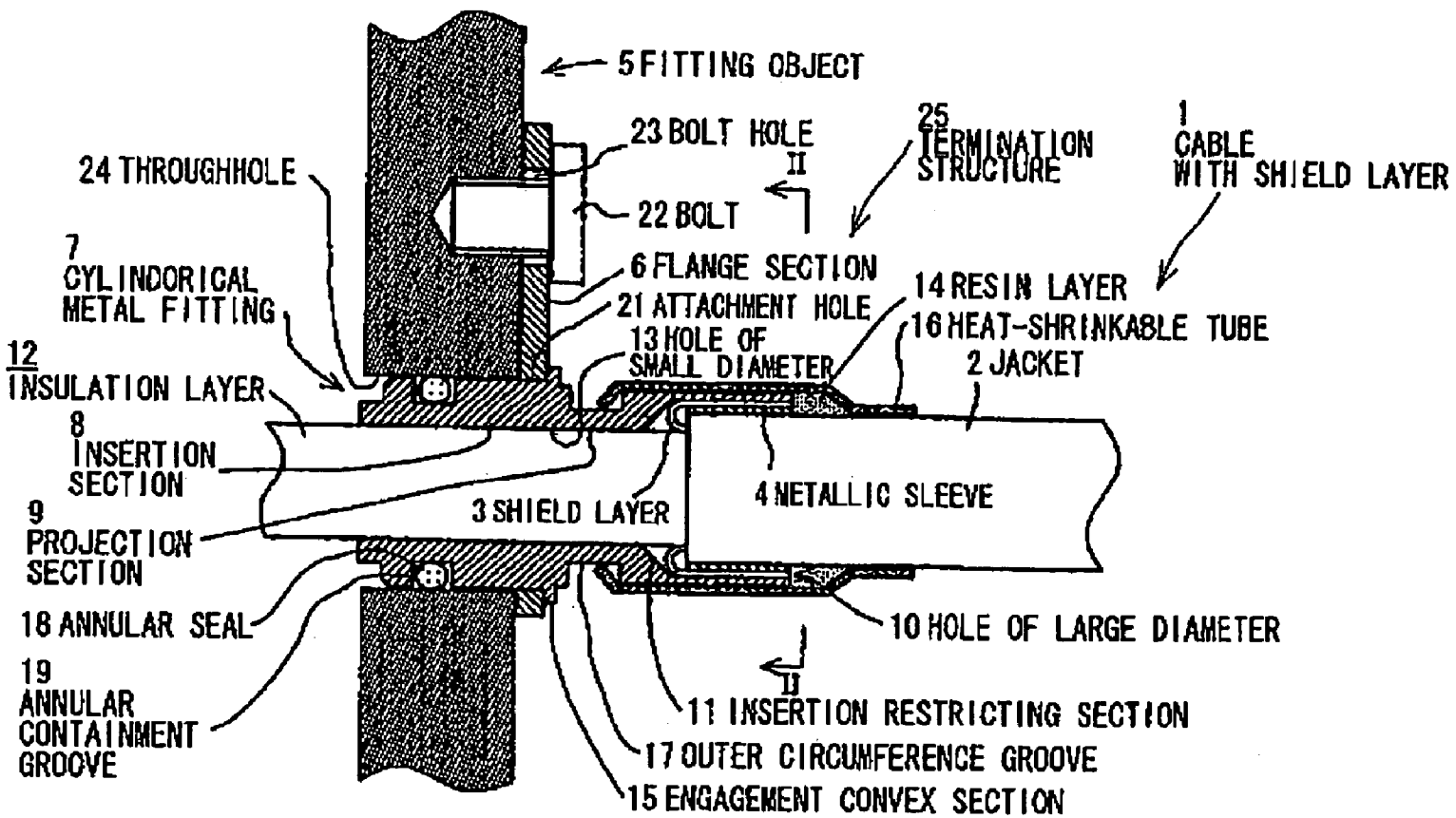
FIG. 2 is a cross sectional view showing a termination structure of a cable with a shield layer in a first preferred embodiment according to the present invention.
Figure 3:
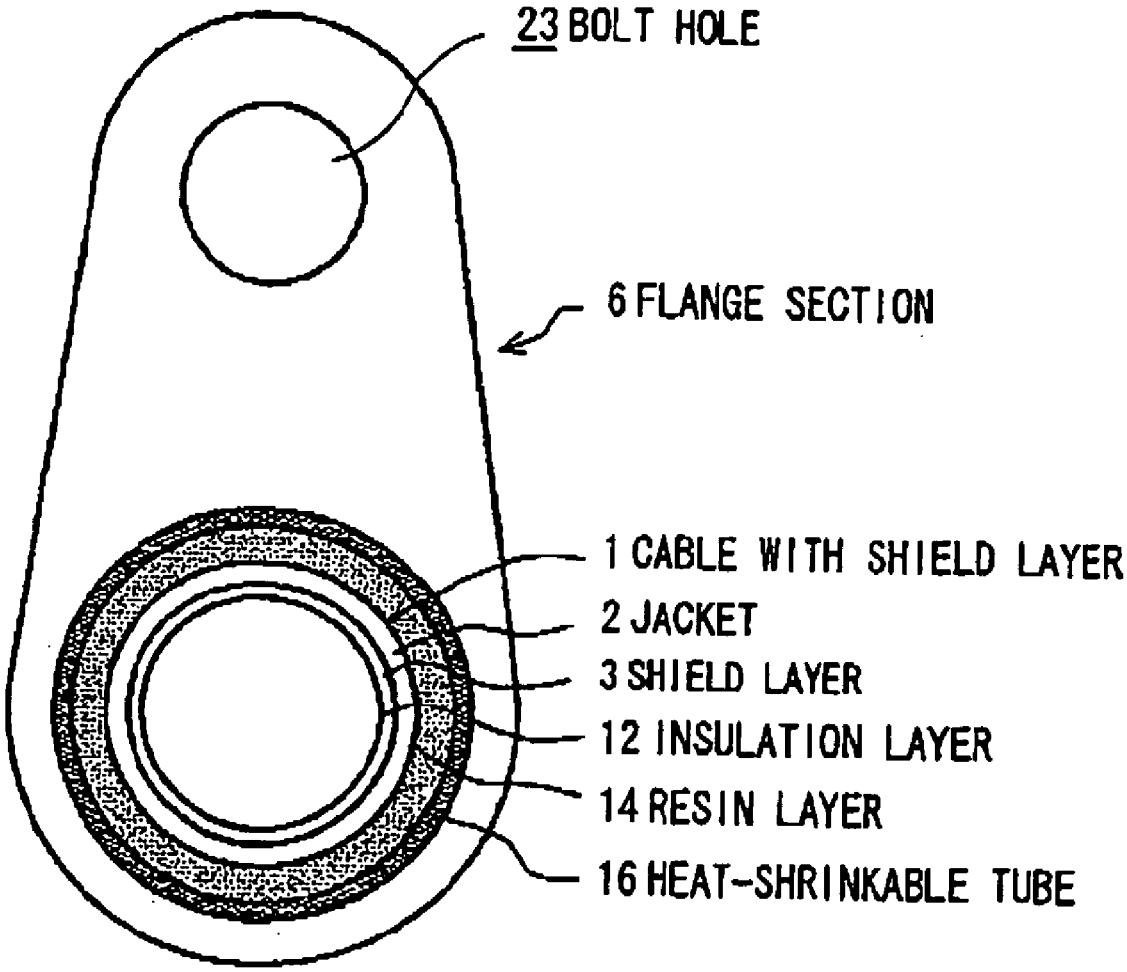
FIG. 3 is a cross sectional view cut along a line II—II in FIG. 2.

FIG. 2 is a cross sectional view showing a termination structure of a cable with a shield layer in the first preferred embodiment according to the present invention. FIG. 3 is a cross sectional view cut along the line II—II in FIG. 2.

As shown in FIGS. 2 and 3, an jacket 2 is cut way to be removed from an end of a cable 1 with a shield layer, so that the shield layer 3 is exposed from beneath the jacket 2. The jacket 2 is covered with a metallic sleeve 4. The metallic sleeve 4 is formed into a cylindrical configuration having a predetermined length in the axial direction, and has an inside diameter which is fitted firmly to the jacket 2 with substantially no clearance when the cable 1 with the shield layer is inserted thereinto.

The shield layer 3 exposed from beneath the jacket 2 cut away is folded back at an end position of the jacket 2 to cover the outer circumference of the metallic sleeve 4. More specifically, the shield layer 3 is turned over at a turning-back point corresponding to the end position of the jacket 2, whereby the shield layer 3 extends in the reverse direction to cover the outer circumference of the metallic sleeve 4. Moreover, the extreme end of the shield layer 3 is trimmed and aligned with an end of the metallic sleeve 4, whereby it is arranged that the shield layer 3 does not protrude from a cylindrical metal fitting 7 which will be mentioned later.

Furthermore, the cylindrical metal fitting 7 having a flange section 6 to be fixed to an object 5 (herein referred to as "fitting object") with which the cable 1 is fitted is fitted around the outer circumference of the folded-back shield layer 3. The cylindrical metal fitting 7 is used to secure the cable 1 with the shield layer to the fitting object 5 being a casing for electrical equipment, and further to ground the shield layer 3 to the fitting object S. The cylindrical metal fitting 7 is swaged to be fixed to the cable 1 with the shield layer. The cylindrical metal fitting 7 is made from a metal having elasticity and plasticity, specifically, brass (yellow brass) and formed into a substantially cylindrical configuration to constitute a housing surrounding the outer circumference of the cable 1 with the shield layer. The cylindrical metal fitting 7 has an insertion section 8 which is formed on a side of an end thereof along the axial direction and to be inserted into the fitting object 5, and a projection section 9 formed on the other end side thereof and to be projected from the Outside of the fitting object 5.

The projection section 9 is fitted around the outer circumference of the folded-back shield layer 3 and formed so as to extend from a projection end thereof in the axial direction with a predetermined length. The projection section 9 has a hole 10 of a large diameter through which the folded-back shield layer 3 is insertable, an insertion restricting section 11 formed by reducing the diameter into a funnel configuration at a back of the hole 10 of a large diameter and for restricting an insertion depth of the shield layer 3, and another hole 13 of a small diameter formed at a back of the insertion restricting section 11 and for inserting an insulation layer 12 exposed from beneath the shield layer 3. At an opening section in the hole 10 of a large diameter, a resin layer 14 is provided for sealing a clearance between the jacket 2 of the cable 1 with the shield layer and the cylindrical metal fitting 7, and the resin layer 14 functions to prevent water which may infiltrate through the surface of the jacket 2. The resin layer 14 is made of a hot-melt type material which melts at 100 to 170° C. Specifically, the resin layer 14 is made of a polyolefin. The resin layer 14 is formed in such that it runs over from the inside of the hole 10 of a large diameter to cover the whole circumference of the extreme end of the projection section 9, whereby the hole 10 of a large diameter is more in water-tightness blocked up. With respect to the projection section 9, an engagement convex section 15 to be engaged with a flange section 6 which will be mentioned later is formed by increasing the diameter so as to expand the outer circumference thereof, and further an outer circumference groove 17 for securing an end of a heat-shrinkable tube 16 which will be mentioned later is formed by decreasing the diameter so as to reduce the outer circumference thereof.

The insertion section 8 is served for inserting the insulation layer 12 being exposed from beneath the shield layer 3 and in the form of the hole 13 of a small diameter extending from the projection section 9. Around the outer circumference of the insertion section 8, an annular seal 18 for sealing a gap between the fitting object 5 and the cylindrical metal fitting 7 is provided. Specifically, the annular seal 18 is an O-ring which is contained in an annular containment groove 19 formed around the outer circumference of the insertion section 8. Moreover, the insertion section 8 is formed in such that the diameter of an end thereof decreases with approach towards the extreme end in multiple stages, so that it may be easily inserted in the fitting object 5.

The flange section 6 is provided with an attachment hole 21 for inserting the insertion section 8 therethrough to attach it to the flange section 6, and the attachment hole 21 is formed incorporatively around the outer circumference of the insertion section 8. Furthermore, the flange section 6 has a bolt hole 23 for inserting a bolt 22, and the bolt 22 is fixed to the fitting object 5 through the bolt hole 23.

In addition, the cylindrical metal fitting 7, the resin layer 14, and the jacket 2 are covered with the heat-shrinkable tube 16, whereby the cable 1 with the shield layer is more waterproofed. The heat-shrinkable tube 16 has also a function as a protective film for the resin layer 14 and the like. More specifically, the heat-shrinkable tube 16 functions to prevent a direct contact of the resin layer 14 and the like with dust or oil, and to protect the resin layer 14 and the like by blocking outdoor air or ultraviolet ray. As a result, degradation of the resin layer 14 and the like due to aged deterioration and the like are suppressed to intend long operating life of the resin layer 14 and the like. The heat-shrinkable tube 16 is made from a resin which shrinks when its temperature exceeds a predetermined temperature. The heat-shrinkable tube 16 covers the resin layer 14, the cylindrical metal fitting 7, and the jacket 2 of the cable 1 with the shield layer, and when the heat-shrinkable tube 16 is thermally shrunk, it is fitted to these components in a closely contact condition.

Besides, since the heat-shrinkable tube 16 is thermally shrunk in such that an end of which is fitted into the outer circumference groove 17, whereby the heat-shrinkable tube 16 gets into the outer circumference groove 17, so that misalignment of the heat-shrinkable tube 16 in the axial direction is prevented. Specifically, the heat-shrinkable tube 16 has such a behavior that it shrinks further when the heat-shrinkable tube 16 is heated at a predetermined shrinkage starting temperature or a higher temperature, even if it is in a once shrunk state, so that there is such tendency that the tube 16 shrunk shifts to a side having a smaller diameter due to such contractive force.

In reality, when a test piece (not shown) different only from the above-mentioned termination structure 25 in that no outer circumference groove 17 exists is prepared. The resulting test piece is subjected to a heat treatment at 120° C. for 24 hours. As a result, a phenomenon wherein the heat-shrinkable tube 16 shifts inevitably was observed. For this reason, it is arranged in such that an end of the heat-shrinkable tube 16 is introduced into the outer circumference groove 17 to prevent shifting of the heat-shrinkable tube 16 along the axial direction thereof. In this case, the heat-shrinkable tube 16 may be the one having an inner layer made of a hot melt. Thus, a sealing property between the cylindrical metal fitting 7 and the jacket 2 can be more elevated.

(Operations and Functions of the First Embodiment)

In the following, the operations and functions of the first embodiment will be described.

When an end of the cable 1 with the shield layer is fitted to the fitting object 5, the jacket 2 is cut away from the end of the cable 1 with the shield layer, and the jacket 2 of the cable 1 with the shield layer is covered with the metallic sleeve 4. Then, the sealed layer 3 exposed is folded back at an end position of the jacket 2 of the shield layer 3 exposed to cover the outer circumference of the metallic sleeve 4.

Thereafter, the cable 1 with the shield layer is inserted in the cylindrical metal fitting 7, the cylindrical metal fitting 7 is fitted around the outer circumference of the shield layer 3, and a clearance between the cylindrical fitting 7 and the jacket 2 is filled with a hot melt which has been previously molten. Before curing the hot melt, an end of the cylindrical metal fitting 7 is swaged to secure the cylindrical metal fitting 7 to the cable 1 with the shield layer. When the hot melt is cured, the resin layer 14 is formed.

Then, the cylindrical metal fitting 7 and the outer circumference of the jacket 2 are covered with the heat-shrinkable tube 16, the insertion section 8 of the cylindrical metal fitting 7 is inserted in a throughhole 24 of the fitting object 5, and the flange section 6 is bolted, whereby the end of the cable 1 with the shield layer can be easily fitted to the fitting object 5.

A gap between the fitting object 5 and the cylindrical metal fitting 7 is sealed by the annular seal 18, while a clearance between the cylindrical metal fitting 7 and the cable 1 with the shield layer is sealed by the resin layer 14, so that no water enters into the fitting object 5.

Furthermore, the cable 1 with the shield layer is grounded by connecting the shield layer 3 to the cylindrical metal fitting 7 inserted into the fitting object 5.

In these circumstances, since the cable 1 with the shield layer is arranged in such that the jacket 2 thereof is comparatively firmly swaged onto the cylindrical metal fitting 7, it does not drop out from the cylindrical metal fitting 7 even when it is pulled.

As described above, the termination structure 25 of the cable 1 with the shield layer is constituted in such that the jacket 2 thereof is covered with the metallic sleeve 4, the shield layer 3 is folded back at an end position of the jacket 2 to cover the outer circumference of the metallic sleeve 4, the cylindrical metal fitting 7 having the flange section to be secured to the fitting object 5 is fitted to the outer circumference of the shield layer 3 thus folded back, an end of the cylindrical metal fitting 7 is swaged to secure to the cable 1 with the shield layer, and the cylindrical metal fitting 7 and the outer circumference of jacket 2 are covered with the heat-shrinkable tube 16. As a consequence, the cable 1 with the shield layer can be easily fitted in water-tightness to the fitting object 5 while grounding the cable 1 with the shield layer for a short period of time. Thus, the number of parts can be reduced, resulting in a low cost. Besides, the jacket 2 is covered with the metallic sleeve 4, and the cylindrical metal fitting 7 is swaged on the metallic sleeve 4, whereby it can be prevented from damaging of the insulation layer 12.

Since the resin layer 14 is disposed in a clearance between the jacket 2 of the cable 1 with the shield layer and the cylindrical metal fitting 7 so as to seal the clearance, permeation of water into the cylindrical metal fitting 7 through the jacket 2 can be prevented, and in turn, permeation of water from the interior of the cylindrical metal fitting 7 to the interior of the fitting object 5 can be prevented.

Moreover, the metallic sleeve 4 has the insertion section 8 to be inserted in the fitting object 5 and the projection section 9 projecting outside the fitting object 5. The projection section 9 is fitted to the outer circumference of the folded-back shield layer 3, while the insertion section 8 through which the insulation layer 12 exposed from beneath the shield layer 3 is inserted, whereby the termination structure 25 may be simplified.

Since the annular seal 18 for sealing a gap between the outer circumference of the insertion section 8 and the fitting object 5 is disposed around the outer circumference of the insertion section 8, the gap between the cylindrical metal fitting 7 and the fitting object 5 can be easily sealed by a simple structure.

Furthermore, the outer circumference groove 17 for fixing an end of the heat-shrinkable tube 16 is formed on the outer circumference of the projection section 9, so that a position of the heat-shrinkable tube 16 to be fixed can be easily stabilized by such simple structure.

Besides, since protection of the resin layer 14 for sealing a gap between the cylindrical metal fitting 7 and the cable 1 with the shield layer is carried out by means of the heat-shrinkable tube 16, an outer diameter of a part protruded from the fitting object 5 towards the outside can be reduced as compared with a case wherein the resin layer 14 is protected by means of a wire seal and the like.

In the present embodiment, although the cylindrical metal fitting 7 is made from brass, the other metals such as aluminum may be applied so far as they do not break up when they are swaged.

In addition, although the resin layer 14 is made from a material of a hot-melt type in the present embodiment, any material which may be cured is applicable, and more specifically, a two-part adhesive wherein two liquids are admixed with each other may be used.

(Modifications of Projection Section)

Figure 4:
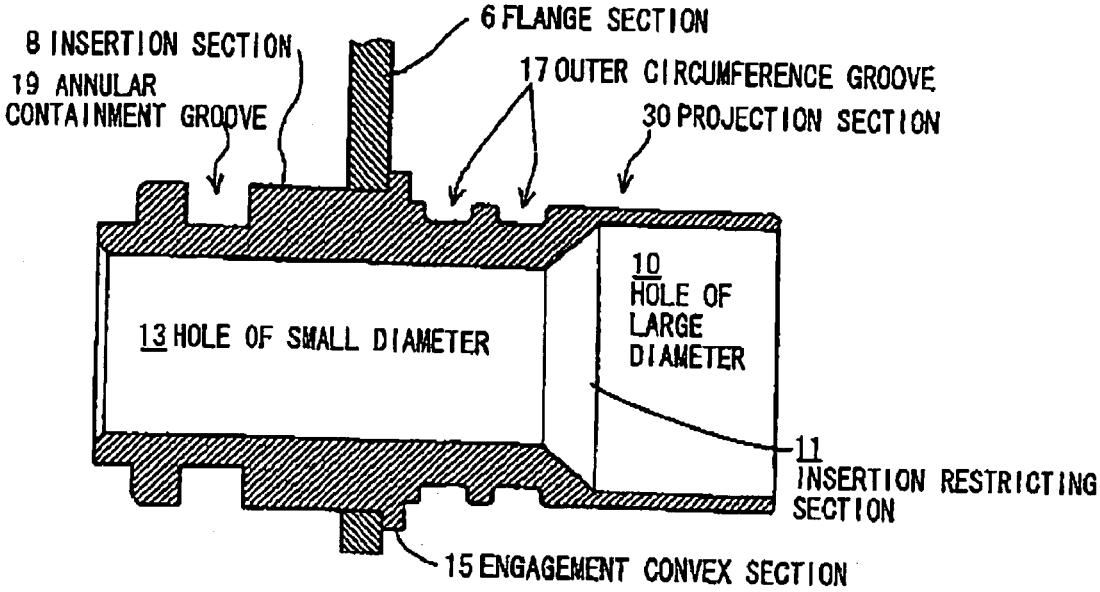
FIG. 4 is a cross sectional view showing a modification of a projection section in FIG. 2.
Figure 5:
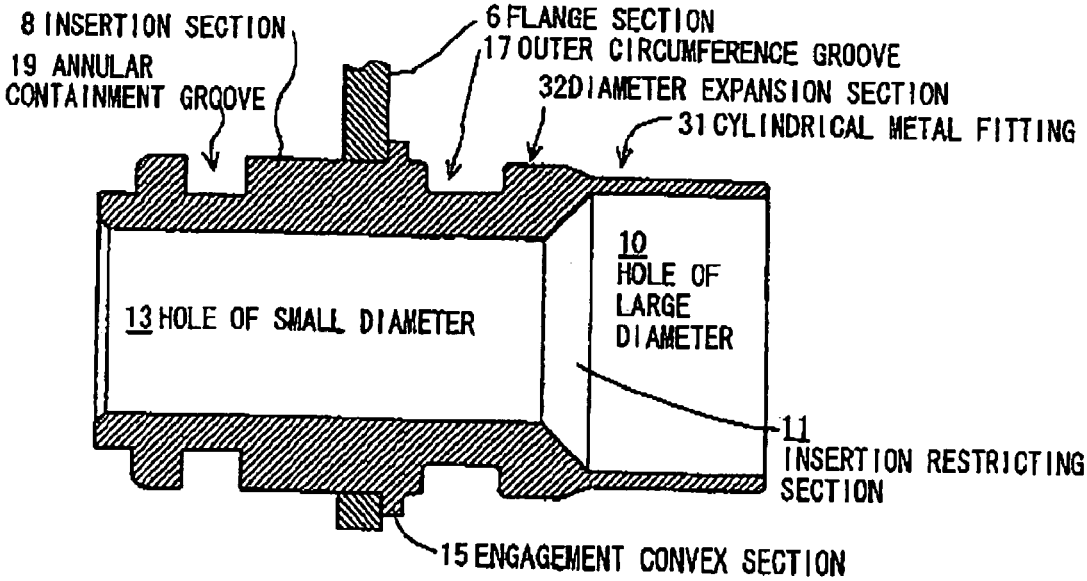
FIG. 5 is a cross sectional view showing another modification of the projection section in FIG. 2.

FIG. 4 is a cross sectional view showing a modification of the projection section in FIG. 2. FIG. 5 is a cross sectional view showing another modification of the projection section in FIG. 2.

Although in the first embodiment the single outer circumference groove 17 is formed around the outer circumference of the cylindrical metal fitting 7, a plurality of outer circumference grooves may be formed around the outer circumference of a cylindrical metal fitting 30 along the axial direction thereof as shown in FIG. 4. Moreover, a diameter expansion section 32 for increasing a depth of an outer circumference groove 17 may be provided around the outer circumference of a cylindrical metal fitting 31 adjacent to the outer circumference groove 17 as shown in FIG. 5. As a result, a position of the heat-shrinkable tube 16 can be more positively stabilized.

Second Embodiment

Figure 6:
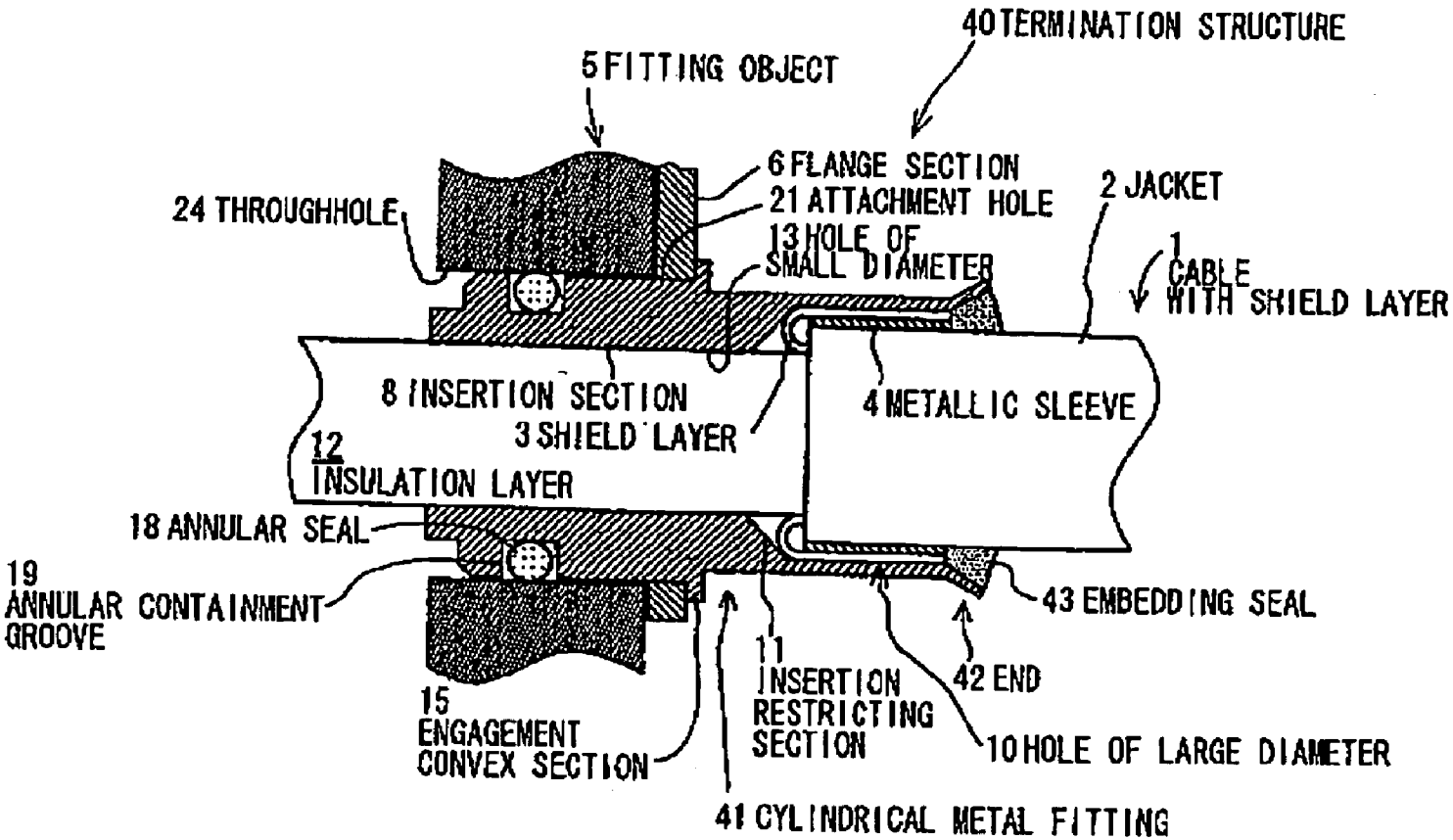
FIG. 6 is a cross sectional view showing a termination structure of a cable with a shield layer in a second preferred embodiment according to the present invention.

FIG. 6 is a cross sectional view showing a termination structure of a cable with a shield layer in the second preferred embodiment according to the present invention. In FIG. 6, like components are indicated by the same numerals as used in FIG. 2.

A termination structure 40 of a cable 1 with a shield layer shown in FIG. 6 is a type wherein a seal structure between the above-mentioned cylindrical metal fitting 7 and the jacket 2 is modified to use no heat-shrinkable tube 16. It is to be noted that the same constitutions and functions as those of the above-mentioned embodiments are represented by the same reference numerals as that of the above-described figures in FIG. 6, and the explanation therefor will be omitted.

As shown in FIG. 6, an jacket 2 is cut away from an end of the cable 1 with the shield layer, so that the shield layer 3 is exposed from beneath the jacket 2. The jacket 2 of the cable 1 with the shield layer is covered with a metallic sleeve 4, and the outer circumference of the metallic sleeve 4 is covered with the shield layer 3 folded back at a position of an end of the jacket 2. Around the outer circumference of the shield layer 3, a cylindrical metal fitting 41 having a flange section to be secured to an object 5 to be fitted (hereinafter referred optionally to as "fitting object") and further, an end 42 which is opened in a horn shape is fitted in such that the end 42 is extended outwardly from the shield layer 3 in the axial direction. The cylindrical metal fitting 41 is swaged over the shield layer 3 to be fixed to the cable 1 with the shield layer. Inside the end 42 of the cylindrical metal fitting 41, an embedding seal 43 for sealing a gap between the cable 1 with the shield layer and the cylindrical metal fitting 41 is disposed. The embedding seal 43 is made from a hot-melt type material which melts at a temperature of 100 to 170° C. Specifically, the embedding seal 43 is made from a polyolefin.

(Operations and Functions of the Second Embodiment)

In the following, operations of the present embodiment will be described.

In the case when an end of the cable 1 with the shield layer is fixed to the fitting object 5, the jacket 2 is cut away from an end of the cable 1 with the shield layer, the jacket 2 remained of the cable 1 with the shield layer is covered with the metallic sleeve 4. Then, the shield layer 3 exposed is folded back at a position of an end of the jacket 2 to cover the outer circumference of the metallic sleeve 4.

Thereafter, the cable 1 with the shield layer is inserted in the cylindrical metal fitting 41, whereby the cylindrical metal fitting 41 is fitted around the outer circumference of the shield layer 3, and the cylindrical metal fitting 41 is swaged to secure it to the cable 1 with the shield layer. Since the end 42 of the cylindrical metal fitting 41 is opened in a horn shape, the cable 1 with the shield layer can be easily inserted in the cylindrical metal fitting 41.

An interior of the end 42 opened in a horn shape of the cylindrical metal fitting 41 is filled with a hot melt which has been previously molten. After the hot melt was cured to form the embedding seal 43, an insertion section 8 of the cylindrical metal fitting 41 is inserted into a throughhole 24 is of the fitting object 5, and a flange section 6 is bolted.

As a consequence, an end of the cable 1 with the shield layer can be fitted easily to the fitting object S.

A gap between the fitting object 5 and the cylindrical metal fitting 41 is sealed by an annular seal 18, while a clearance between the cylindrical metal fitting 41 and the cable 1 with the shield layer is sealed by the embedding seal 43, and accordingly, no water permeates inside the fitting object 5 from the outside.

As described above, the end 42 opened in a horn shape is extended outwardly from the shield layer 3 in the axial direction, and the embedding seal 43 is disposed inside the end 42, so that a heat-shrinkable tube can be omitted in the present embodiment. As a result, the cable 1 with the shield layer can be easily fitted to the fitting object 5 for a short period of time, and the cost therefor can be reduced. Furthermore, since no heat-shrinkable tube is used, a length of a part of the termination structure protruded from the fitting object 5 can be shortened.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A termination structure of a cable with a shield layer wherein a part of a jacket of the cable is removed at an end of the cable to expose a part of the shield layer and the exposed part of the shield layer is grounded to a fitting object and the cable is fitted in water-tightness with the fitting object, comprising:

a metallic sleeve disposed on the jacket of the cable, the metallic sleeve being covered with the exposed part of the shield layer being folded at an end of the jacket;

a cylindrical metal fitting comprising a flange section through which the cylindrical metal fitting is secured to the fitting object, the cylindrical metal fitting being disposed on the periphery of the folded shield layer and swaged at a fixing section corresponding to the folded shield layer to fix the cable; and a heat-shrinkable tube disposed on the periphery of the cylindrical metal fitting and the jacket.

2. The termination structure according to claim 1, further comprising:

a resin layer formed in a gap between the jacket of the cable and the cylindrical metal fitting to seal the gap.

3. The termination structure according to claim 1, wherein:

the cylindrical metal fitting comprises an insertion section being inserted into the fitting object and a projection section protruding outside the fitting object, the projection section is disposed on the periphery of the folded shield layer, and an insulation layer of the cable exposed without the shield layer is inserted through the insertion section into the cylindrical metal fitting.

4. The termination structure according to claim 2, wherein:

the cylindrical metal fitting comprises an insertion section being inserted into the fitting object and a projection section protruding outside the fitting object, the projection section is disposed on the periphery of the folded shield layer, and an insulation layer of the cable exposed without the shield layer is inserted through the insertion section into the cylindrical metal fitting.

5. The termination structure according to claim 3, further comprising:

an annular seal disposed on the periphery of the insertion section to seal a gap between the insertion section and the fitting object.

6. The termination structure according to claim 3, wherein:

the projection section comprises a groove formed on its periphery to engage an end of the heat-shrinkable tube with the groove to fix the tube.

7. The termination structure according to claim 6, wherein:

the projection section comprises a plurality of the grooves formed on the periphery in an axial direction of the cylindrical metal fitting.

8. The termination structure according to claim 6, wherein:

the projection section comprises a diameter expansion section formed adjacent to the groove on the periphery to increase a depth of the groove.

9. A termination structure of a cable with a shield layer wherein a part of a jacket of the cable is removed at an end of the cable to expose a part of the shield layer and the exposed part of the shield layer is grounded to a fitting object and the cable is fitted in water-tightness with the fitting object, comprising:

a metallic sleeve disposed on the jacket of the cable, the metallic sleeve being covered with the exposed part of the shield layer being folded at an end of the jacket;

a cylindrical metal fitting comprising a flange section through which the cylindrical metal fitting is secured to the fitting object, and an end section formed in a horn shape that allows an end of the cylindrical metal fitting to open radially from an axis of the cable, the cylindrical metal fitting being disposed on the periphery of the folded shield layer and swaged at a fixing section corresponding to the folded shield layer to fix the cable; and an embedding seal provided in the end section to seal a gap between the cable and the cylindrical metal fitting.

* * * * *